US010525575B2

(12) United States Patent
Tanji

(10) Patent No.: US 10,525,575 B2
(45) **Date of Patent: *Jan. 7, 2020**

(54) DRIVER

(71) Applicant: HITACHI KOKI CO., LTD., Tokyo (JP)

(72) Inventor: Isamu Tanji, Hitachinaka (JP)

(73) Assignee: KOKI HOLDINGS CO., LTD., Tokyo (JP)

( * ) Notice: Subject to any disclaimer, the term of this patent is extended or adjusted under 35 U.S.C. 154(b) by 645 days.

This patent is subject to a terminal disclaimer.

(21) Appl. No.: 14/765,803

(22) PCT Filed: Feb. 28, 2014

(86) PCT No.: PCT/JP2014/055092

§ 371 (c)(1),
(2) Date: Aug. 4, 2015

(87) PCT Pub. No.: WO2014/156470

PCT Pub. Date: Oct. 2, 2014

(65) Prior Publication Data

US 2015/0375381 A1 Dec. 31, 2015

(30) Foreign Application Priority Data

Mar. 29, 2013 (JP) ..... 2013-074377

(51) Int. Cl.
*B25C 1/06* (2006.01)
*B25F 5/00* (2006.01)

(52) U.S. Cl.
CPC ..... *B25C 1/06* (2013.01); *B25F 5/006* (2013.01)

(58) Field of Classification Search
CPC ... B25F 5/006; B25C 1/06; B25C 1/00; B25C 1/008

(Continued)

(56) References Cited

U.S. PATENT DOCUMENTS 4,515,303 A 5/1985 Schadlich et al.
4,834,278 A * 5/1989 Lin ..... B25C 1/06 227/131

(Continued)

FOREIGN PATENT DOCUMENTS

DE 10 2005 000089 A1 1/2007
EP 1 980 369 A2 10/2008

(Continued)

OTHER PUBLICATIONS

International Search Report PCT/JP2014/050092 dated Apr. 28, 2014 with English translation.

(Continued)

*Primary Examiner* — Alexander M Valvis
*Assistant Examiner* — Thomas M Wittenschlaeger
(74) *Attorney, Agent, or Firm* — McDermott Will & Emery LLP

(57) ABSTRACT

The durability of the driver is further improved. The nail driver for driving a nail into a material to be driven includes: a plunger moved in a first direction parallel to a driving direction of the nail by bias caused by a coil spring and moved in a second direction opposite to the first direction against the bias of the coil spring (25); and a weight moved in the second direction by bias caused by a coil spring and moved in the first direction against the bias of the coil spring. The weight (24) is moved in the second direction when the plunger is moved in the first direction and is moved in the first direction when the plunger is moved in the second direction, and the plunger and the weight are moved in the first direction and the second direction so as to be independent from each other.

16 Claims, 13 Drawing Sheets

(58) Field of Classification Search
USPC ..... 227/131, 132
See application file for complete search history.

(56) References Cited

U.S. PATENT DOCUMENTS

| | | | | |
|---|---|---|---|---|
| 5,118,023 | A * | 6/1992 | Fushiya | B25C 1/06 227/131 |
| 5,437,339 | A | 8/1995 | Tanaka | |
| 5,503,319 | A * | 4/1996 | Lai | B25C 5/15 173/203 |
| 5,720,423 | A * | 2/1998 | Kondo | B25C 1/04 227/130 |
| 7,104,432 | B2 * | 9/2006 | Sun | B25C 1/06 173/124 |
| 7,513,407 | B1 * | 4/2009 | Chang | B25C 1/06 173/202 |
| 7,815,088 | B2 * | 10/2010 | Fielitz | B25C 5/15 227/129 |
| 7,832,610 | B2 | 11/2010 | Tanimoto et al. | |
| 8,186,553 | B2 | 5/2012 | Tanimoto et al. | |
| 8,393,512 | B2 | 3/2013 | Tanimoto et al. | |
| 2007/0284406 | A1 * | 12/2007 | Okouchi | B25C 1/06 227/132 |
| 2008/0257934 | A1 | 10/2008 | Tanimoto et al. | |
| 2008/0296339 | A1 | 12/2008 | Fielitz et al. | |
| 2009/0078734 | A1 | 3/2009 | Chang | |
| 2009/0236387 | A1 | 9/2009 | Simonelli et al. | |
| 2010/0133313 | A1 | 6/2010 | Nakano et al. | |
| 2011/0000949 | A1 | 1/2011 | Ito et al. | |
| 2012/0211540 | A1 * | 8/2012 | Kondou | B25C 1/06 227/140 |

FOREIGN PATENT DOCUMENTS

| | | | |
|---|---|---|---|
| EP | 2 140 979 | A1 | 1/2010 |
| EP | 2 489 474 | A2 | 8/2012 |
| EP | 2 607 022 | A2 | 6/2013 |
| JP | 59-59361 | A | 4/1984 |
| JP | 05-261677 | A | 10/1993 |
| JP | 06-33675 | U | 5/1994 |
| JP | 9-295283 | A | 11/1997 |
| JP | 2008-238288 | A | 10/2008 |
| JP | 2008-260124 | A | 10/2008 |
| JP | 2009-000756 | A | 1/2009 |
| JP | 2010-125578 | A | 6/2010 |
| JP | 2011-67925 | A | 4/2011 |
| JP | 2012-236251 | A | 12/2012 |

OTHER PUBLICATIONS

International Search Report issued in corresponding International Patent Application No. PCT/JP2014/067144 ,dated Aug. 12, 2014, with English Translation.

Extended European Search Reportissued in corresponding European Patent Application No. 14832851.1-1701, dated Feb. 15, 2017.

U.S. PTO Non-Final Office Action issued in related U.S. Appl. No. 14/908,968, dated May 10, 2018.

U.S. PTO Notice of Allowance issued in related U.S. Appl. No. 14/908,968, dated Oct. 17, 2018.

U.S. Appl. No. 14/908,968, filed Jan. 29, 2016, now U.S. Pat. No. 10,195,728 issued Feb. 9, 2019.

* cited by examiner 24
203
24a
24b
21d
202a
203a
202
21c
30

DRIVER

CROSS-REFERENCE TO RELATED APPLICATIONS

This application is the U.S. National Phase of PCT/JP2014/055092 filed Feb. 28, 2014, which claims priority to Japanese Patent Application No. 2013-074377 filed Mar. 29, 2013. The subject matter of each is incorporated herein by reference in entirety.

TECHNICAL FIELD

The present invention relates to a driver that drives a fastener such as a nail or a pin into a material to be driven such as a wood material or a gypsum board.

BACKGROUND ART

A driver which moves a driving tool and drives a fastener into a material to be driven by utilizing the restoring force of an elastic body such as a coil spring is known. Some of drivers of this type are provided with a mechanism for absorbing or reducing the reaction caused when the fastener is driven.

For example, Patent Document 1 describes a weight (weight device) which is moved in the opposite direction of a driving direction to reduce the reaction at the driving when an active member (active device) provided with a nail driving tool is moved in the driving direction of a nail. A rack gear is formed on each of the active member and the weight. Moreover, a common pinion gear always meshed with each rack gear is provided between the active member and the weight. Along with the rotation of the pinion gear in a predetermined direction, the active member is moved in the direction opposite to the driving direction, and the weight is moved in the driving direction. Then, when the active member is moved in the driving direction while rotating the pinion gear in the direction opposite to the above-described predetermined direction, the weight is moved in the direction opposite to the driving direction along with the rotation of the pinion gear, so that the reaction at the driving is reduced.

PRIOR ART DOCUMENT

Patent Document

Patent Document 1: U.S. Pat. No. 7,513,407

SUMMARY OF THE INVENTION

Problems to be Solved by the Invention

In the mechanism described in Patent Document 1, the active member and the weight are coordinated with each other. Specifically, the active member and the weight are connected via the common pinion gear. Therefore, if the movement of the active member in the driving direction is suddenly stopped due to any reason, large impact is applied to the teeth of the rack gear and the pinion gear which are meshed with each other, and therefore, there is a risk that either one or both of the gears is broken.

Patent Document 1 also describes a mode in which the active member and the weight are coupled to each other by a common wire (pulling member). In this mode, if the movement of the active member in the driving direction is suddenly stopped due to any reason, large impact is applied to the wire itself or the connecting part between the wire and the weight or the active member, and therefore, there is a risk that the wire is disconnected, or the connecting part is broken.

An object of the present invention is to further improve the durability of the driver.

Means for Solving the Problems

A driver of the present invention is a driver for driving a fastener into a material to be driven, and has: a plunger moved in a first direction parallel to a driving direction of the fastener by bias caused by a first elastic body and moved in a second direction opposite to the first direction against the bias of the first elastic body; and a weight moved in the second direction by bias caused by a second elastic body and moved in the first direction against the bias of the second elastic body. The weight is moved in the second direction when the plunger is moved in the first direction, the weight is moved in the first direction when the plunger is moved in the second direction, and the plunger and the weight are moved in the first direction and the second direction so as to be independent from each other.

An aspect of the present invention is provided with: a drive source generating drive force that moves the plunger against the bias of the first elastic body and moves the weight against the bias of the second elastic body; a rotating body which is rotated by the drive source; a first power transmission path provided between the rotating body and the plunger; and a second power transmission path provided between the rotating body and the weight.

In another aspect of the present invention, the first elastic body is disposed in a cylinder in which the plunger is housed so as to freely reciprocate, and the second elastic body and the weight are disposed in periphery of the cylinder.

In another aspect of the present invention, the first elastic body and the second elastic body are coil springs, the weight has a cylindrical shape, and the first elastic body, the second elastic body, and the weight are coaxially disposed.

In another aspect of the present invention, the plunger, the weight, and the first elastic body are coaxially disposed.

In another aspect of the present invention, the first power transmission path is configured by a gear group including a gear integrally rotated with the rotating body, a drum rotated by drive force transmitted via the gear group, and a wire whose one end is coupled to the drum and whose other end is coupled to the plunger. Also, the second power transmission path is configured by an engagement part switched to an engaged state in which it is integrally rotated with the rotating body so as to be engaged with the weight and an unengaged state in which it is not engaged with the weight.

In another aspect of the present invention, the driver is provided with a clutch mechanism provided at the first power transmission path and switched to a fastened state in which the drive force is transmitted to the plunger and a released state in which the drive force is not transmitted to the plunger, and the engagement part is switched from the engaged state to the unengaged state at the same time as when or immediately after the clutch mechanism is switched from the fastened state to the released state.

In another aspect of the present invention, a first engagement part and a second engagement part sequentially engaged with the weight are provided. The first engagement part is engaged with the weight so as to be earlier than the second engagement part and moves the weight in the second direction, and the second engagement part is engaged with the weight so as to be later than the first engagement part and further moves the weight in the second direction.

Effects of the Invention

According to the present invention, the durability of the driver can be further improved.

BRIEF DESCRIPTIONS OF THE DRAWINGS

DETAILED DESCRIPTION OF PREFERRED EMBODIMENTS

First Embodiment

Hereinafter, an example of embodiments of a nail driver of the present invention will be explained in detail with reference to FIG. 1 to FIG. 5. The driver according to the present embodiment is a driver which drives a nail serving as a fastener into a material to be driven such as a wood material or a gypsum board by a reciprocated driver blade.

Figure 1:
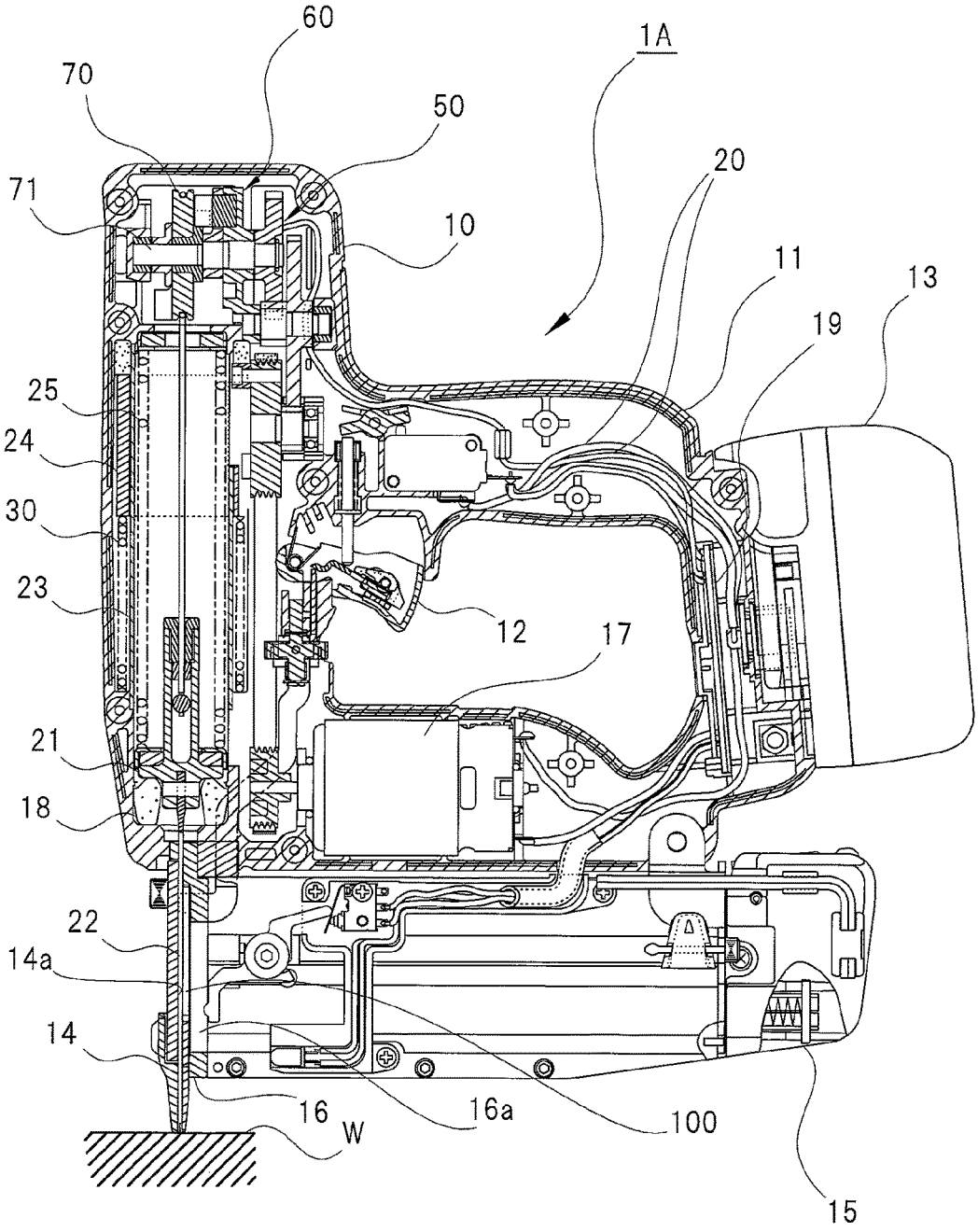
FIG. 1 is a cross-sectional view of a nail driver according to a first embodiment and is a cross-sectional view obtained when a plunger is positioned at a bottom dead point and a weight is positioned at a top dead point.

A nail driver 1A shown in FIG. 1 has a housing 10 made of a resin such as nylon or polycarbonate. The housing 10 is integrally provided with a handle 11, and the handle 11 is provided with a trigger switch 12. Moreover, an attachable battery 13 is attached to a back surface of the handle 11. Furthermore, a nose part 14 is provided below the housing 10, and a magazine 15 extending in the same direction as the handle 11 is provided in the rear of the nose part 14.

A plurality of aligned and coupled nails 100 are loaded and retained in the magazine 15. The nails 100 retained in the magazine 15 are supplied to an injection outlet 14*a* in the nose part 14 through a supply path 16*a* provided in a blade guide 16.

In the housing 10, an electric motor 17 serving as a drive source and a cylinder 23 in which an integrated plunger 21 and driver blade 22 are housed so as to freely reciprocate are housed. In the housing 10 and in the periphery of the cylinder 23, a weight 24 which has a substantially cylindrical shape and is reciprocable along the cylinder 23 is disposed. Note that a piston bumper 18 serving as a buffer material for moderating the impact caused when the plunger 21 is moved downward is disposed at an inner lower end of the housing 10. The piston bumper 18 is made of a soft rubber or made of a resin such as urethane, is disposed below the plunger 21, and abuts on a lower end surface of the plunger 21. Furthermore, in the housing 10, an electric-power control part 19 for supplying the electric power, which is stored in the battery 13, to the electric motor 17, etc., and various cables 20, etc. are provided.

A coil spring 25 serving as a first elastic body is housed in the cylinder 23 housing the plunger 21 and the driver blade 22, and a coil spring 30 serving as a second elastic body is disposed in periphery of the cylinder 23. The plunger 21, the coil springs 25 and 30, and the weight 24 are coaxially disposed. That is, the respective central axes of the plunger 21, the coil springs 25 and 30, and the weight 24 are arranged on the same straight line.

The plunger 21 and the driver blade 22 shown in the drawings can be integrally moved in a first direction which is parallel to the driving direction of the nails 100 and in a second direction which is opposite to the first direction. That is, the plunger 21 and the driver blade 22 are reciprocable in the first direction and the second direction. When the driver blade 22 is moved in the first direction, the driver blade 22 ejects a nail 100 which is at the top of the coupled nails loaded in the magazine 15, and drives the nail 100 into a material W to be driven. A lower side of the sheet in the example shown in FIG. 1 is the first direction (driving direction), and an upper side of the sheet therein is the second direction. Accordingly, in the following explanations, the first direction is referred to as "lower side" and the second direction is referred to as "upper side" in some cases.

Figure 2:
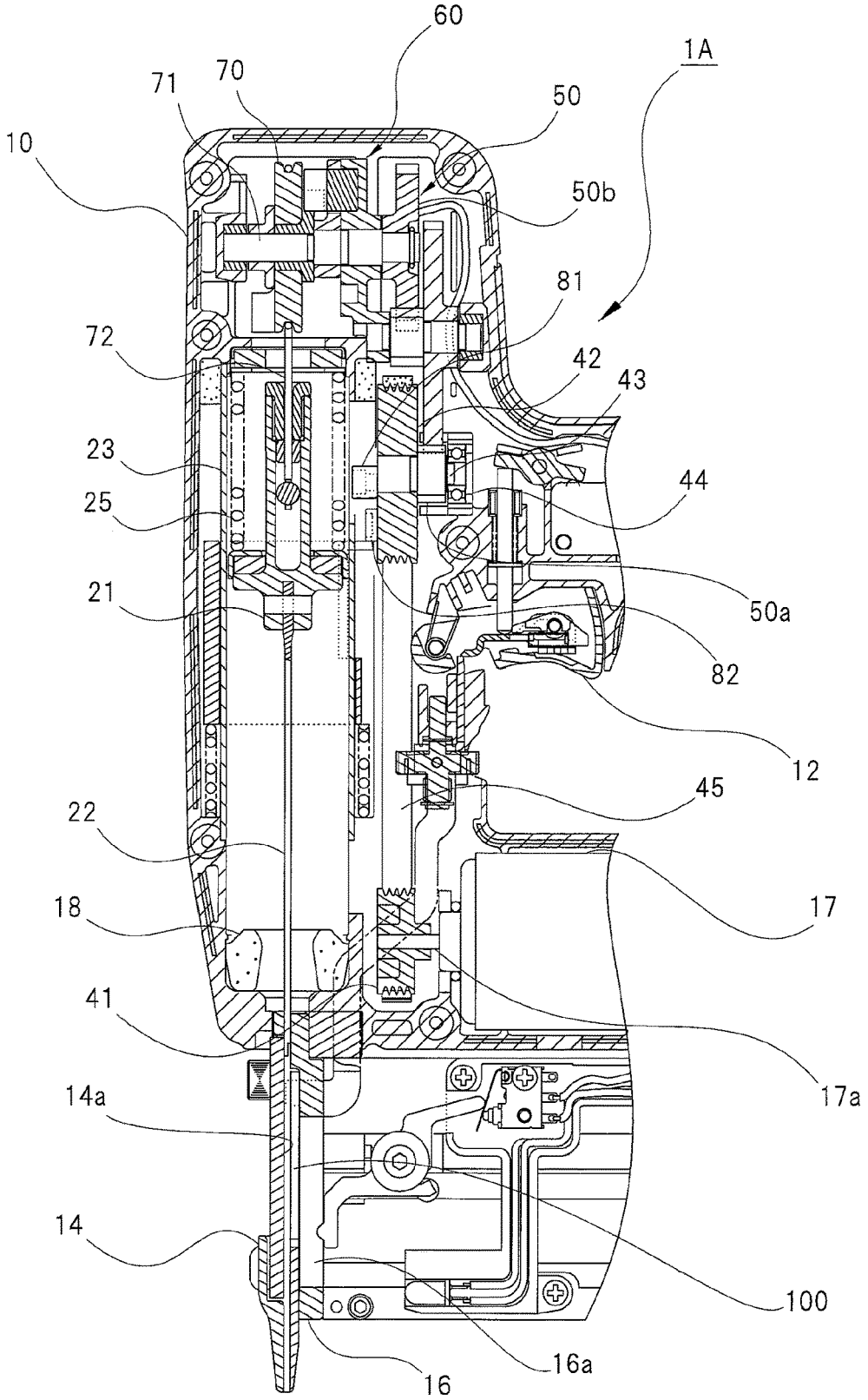
FIG. 2 is a partially enlarged cross-sectional view of the nail driver according to the first embodiment and is a partially enlarged cross-sectional view obtained when the plunger is positioned at a top dead point and the weight is positioned at a bottom dead point.

As shown in FIG. 2, the electric motor 17 is provided with an output shaft 17*a* serving as a rotary shaft part. The electric motor 17 is disposed so that the axial direction of the output shaft 17*a* is perpendicular to the first direction and the second direction. That is, the output shaft 17*a* of the electric motor 17 is parallel to a front-rear direction of a main body of the nail driver.

A first pulley 41 is provided at the output shaft 17*a* of the electric motor 17, and a second pulley 42 is provided above the first pulley 41. One end side of a rotary shaft 43 is fixed to the center of the second pulley 42, and the other end side of the rotary shaft 43 is protruded outward from a first side surface of the second pulley 42. An end of the protruding part of the rotary shaft 43 is supported by a bearing 44 so as to be freely rotate, and a power transmission belt 45 is wound around the first pulley 41 and the second pulley 42. Therefore, when the electric motor 17 is actuated, the first pulley 41 and the second pulley 42 are rotated. That is, the second pulley 42 is a rotating body which is rotated by the electric motor 17. Note that, when the nose part 14 shown in FIG. 1 is pushed against the material W to be driven and is pushed into the housing 10 and when the trigger switch 12 is pushed, electric power is supplied to the electric motor 17, so that the electric motor 17 is actuated. That is, the output shaft 17*a* of the electric motor 17 is rotated in a predetermined direction.

As shown in FIG. 2, a first-stage gear 50*a* of a gear group configuring a speed reduction mechanism 50 is fixed to the protruding part of the rotary shaft 43 of the second pulley 42. That is, the gear 50*a* configuring the speed reduction mechanism 50 integrally rotates with the second pulley 42. On the other hand, a final-stage gear 50*b* of the gear group configuring the speed reduction mechanism 50 is coupled to a clutch mechanism 60, which is disposed in an upper part of the housing 10. The clutch mechanism 60 is interposed between the final-stage gear 50*b* of the speed reduction mechanism 50 and a drive shaft 71 of the drum 70, and is alternately switched to a fastened state in which the drive force output from the speed reduction mechanism 50 is transmitted to the drive shaft 71 of the drum 70 and a released state in which the drive force output from the speed reduction mechanism 50 is not transmitted to the drive shaft 71 of the drum 70. One end of a wire 72 is coupled to the drum 70, and the other end of the wire 72 is coupled to the plunger 21.

When the electric motor 17 is actuated so as to rotate the second pulley 42, the drive force is transmitted to the drive shaft 71 of the drum 70 via the speed reduction mechanism 50 and the clutch mechanism 60 which is in the fastened state, so that the drum 70 is rotated in a predetermined direction. When the drum 70 is rotated in the predetermined direction, the wire 72 is wound up, so that the plunger 21 coupled to the wire 72 is moved up in the cylinder 23. That is, the first power transmission path is configured between the second pulley 42 and the plunger 21 by the gear group configuring the speed reduction mechanism 50, the clutch mechanism 60, the drum 70, the wire 72, etc., so that the plunger 21 and the driver blade 22 are moved upward (in the second direction) by the drive force transmitted through this path. At this time, the plunger 21 moved upward in the cylinder 23 is moved up while compressing the coil spring 25 housed in the cylinder 23. In other words, the plunger 21 is moved upward against the bias of the coil spring 25.

Figure 3:
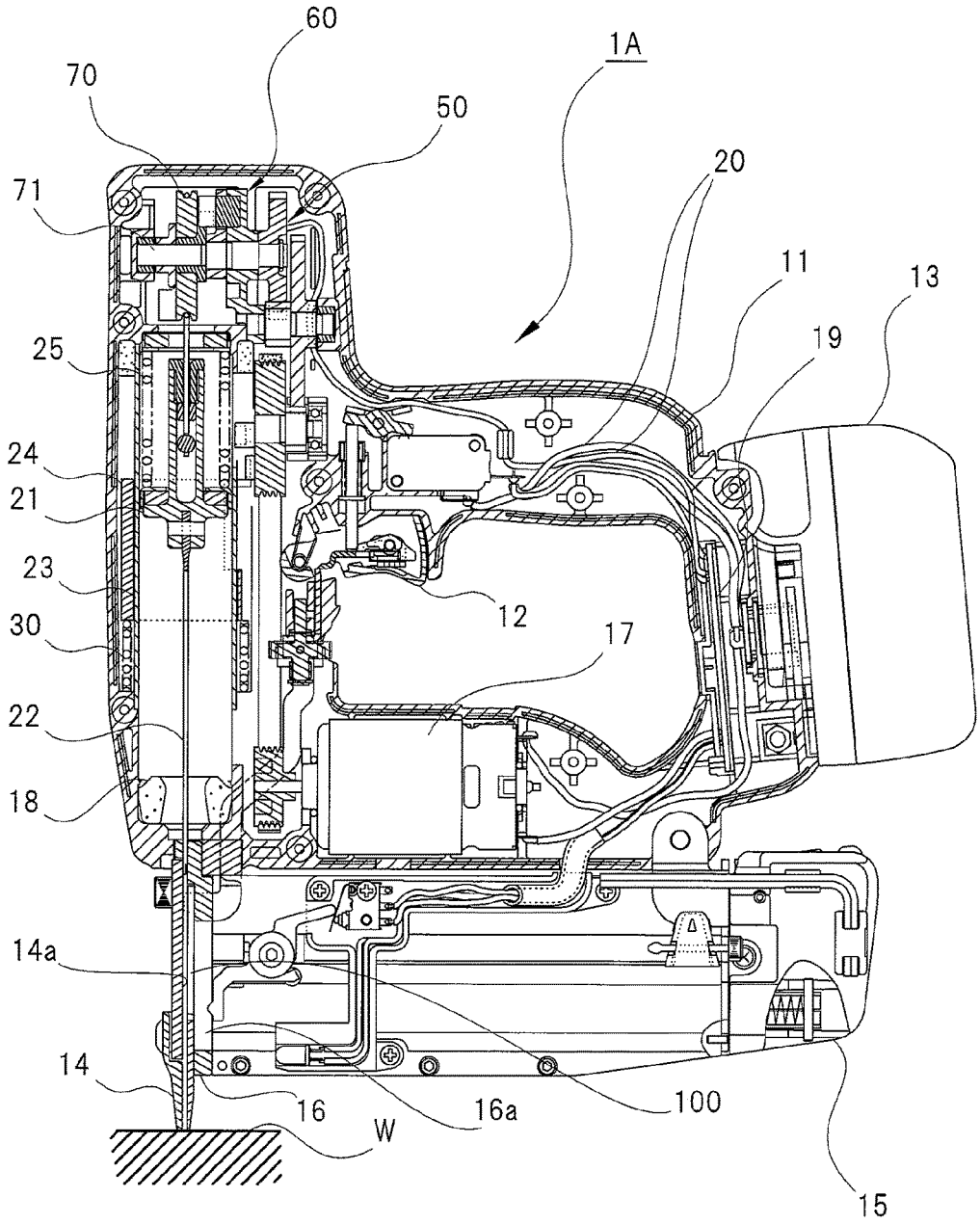
FIG. 3 is a cross-sectional view of a nail driver according to a first embodiment and is a cross-sectional view obtained when the plunger is positioned at the top dead point and the weight is positioned at the bottom dead point.

As described above, when the second pulley 42 is rotated by the electric motor 17, the plunger 21 shown in FIG. 1 is moved up to the position shown in FIG. 3 so as to be against the bias of the coil spring 25. That is, the position shown in FIG. 1 is a bottom dead point of the plunger 21, the position shown in FIG. 3 is a top dead point of the plunger 21, and the plunger 21 is moved from the bottom dead point to the top dead point by the drive force transmitted via the first power transmission path.

When the plunger 21 reaches the position (top dead point) shown in FIG. 3, the clutch mechanism 60 is switched from the fastened state to the released state. When the clutch mechanism 60 is switched to the released state, the coupling between the speed reduction mechanism 50 and the drive shaft 71 of the drum 70 is released, so that the drive shaft 71 of the drum 70 freely moves. Since the drive shaft 71 of the drum 70 freely moves, the plunger 21 is pushed down by the elastic restoring force of the compressed coil spring 25. That is, the plunger 21 is moved downward (in the first direction) by the bias of the coil spring 25. In other words, the plunger 21 is moved down to the position (bottom dead point) shown in FIG. 1 at once. Along with the downward movement of the plunger 21, the driver blade 22 is also moved down, so that the nail 100 supplied from the magazine 15 is driven into the material W to be driven.

Figure 4A:
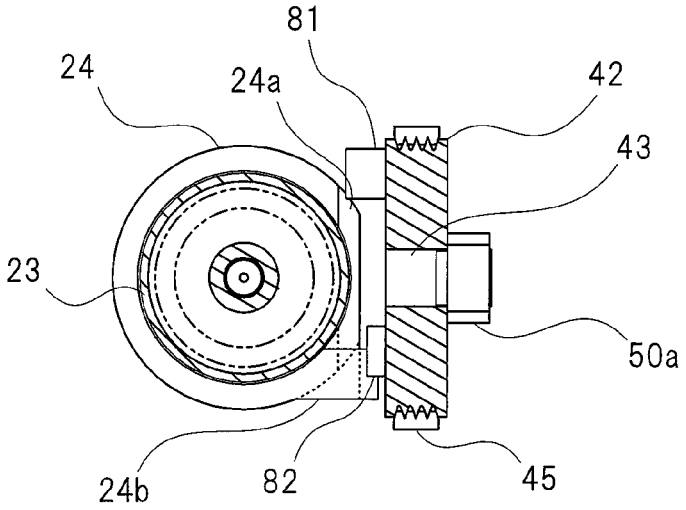
FIG. 4A is a cross-sectional view showing an engaged state of the weight and engagement pins.

As shown in FIG. 2 and FIG. 4A, a first engagement part and a second engagement part are provided on a second side surface (a side surface opposite to the first side surface) of the second pulley 42. Specifically, a first engagement pin 81 and a second engagement pin 82 extending in the opposite direction to that of the rotary shaft 43 are provided on the second side surface of the second pulley 42. As shown in FIG. 4A, the first engagement pin 81 is longer than the second engagement pin 82. That is, the protruding length of the first engagement pin 81 with respect to the second side surface of the second pulley 42 is longer than the protruding length of the second engagement pin 82.

Figure 4B:
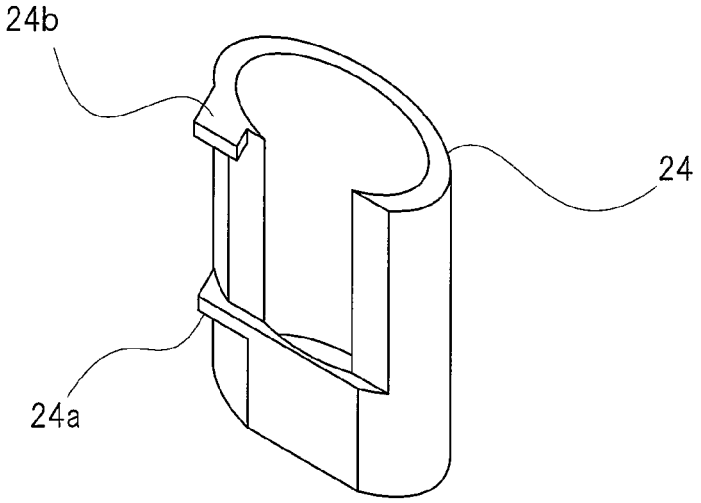
FIG. 4B is a perspective view of the weight.

On the other hand, as shown in FIGS. 4A and 4B, the weight 24 has a partially-cut-away substantially cylindrical shape. A first engagement protrusion 24*a* engaged with the first engagement pin 81 and a second engagement protrusion 24*b* engaged with the second engagement pin 82 are formed on the weight 24. As shown in FIG. 4A, the protruding length of the first engagement protrusion 24*a* with respect to the weight outer peripheral surface is shorter than the protruding length of the second engagement protrusion 24*b*.

Figure 5A:
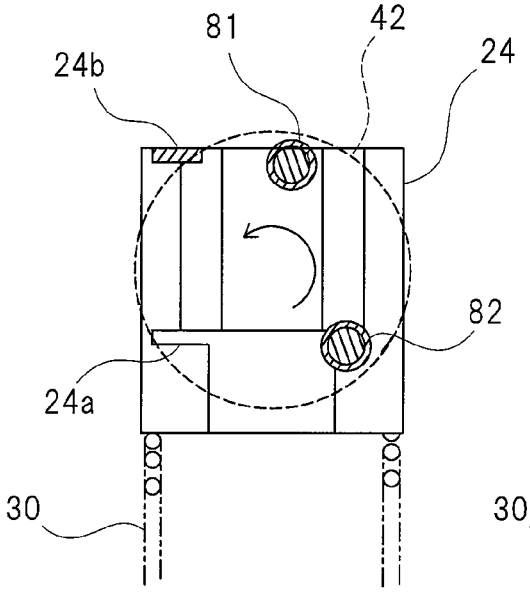
FIGS. 5A to 5D are schematic views showing changes in the engaged state of the weight and the engagement pins.
Figure 5B:
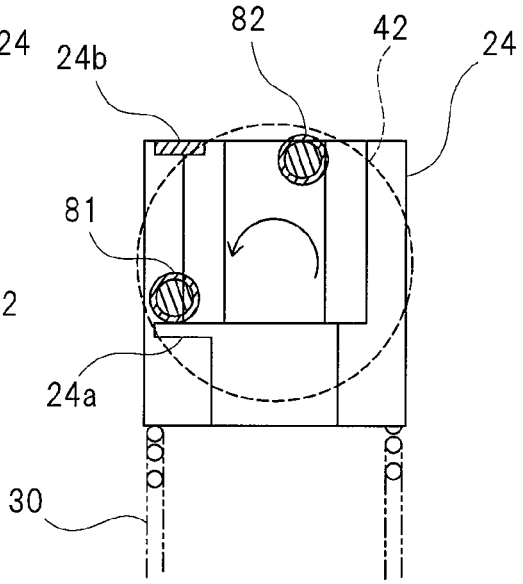

The first engagement pin 81 and the second engagement pin 82 are sequentially engaged with the weight 24 along with the rotation of the second pulley 42. Hereinafter, this engagement will be explained in detail with reference to FIGS. 5A to 5D. When the second pulley 42 shown in FIG. 5A is rotated in an arrow direction, the first engagement pin 81 abuts on and is engaged with the first engagement protrusion 24*a* of the weight 24 from above as shown in FIG. 5B. As shown in FIG. 5A, when the first engagement pin 81 does not abut on the first engagement protrusion 24*a*, the weight 24 is at the position shown in FIG. 1. Also, as shown in FIG. 5B, even when the first engagement pin 81 abuts on the first engagement protrusion 24*a*, if the first engagement pin 81 does not press the first engagement protrusion 24*a*, the weight 24 is at the position shown in FIG. 1.

Then, when the second pulley 42 shown in FIG. 5B is rotated in the arrow direction, the weight 24 is pushed down along the outer peripheral surface of the cylinder 23 (FIG. 1). At this time, the weight 24 moved down along the outer peripheral surface of the cylinder 23 is moved downward while compressing the coil spring 30 disposed in the periphery of the cylinder 23. In other words, the weight 24 is moved downward so as to be against the bias of the coil spring 30.

Figure 5C:
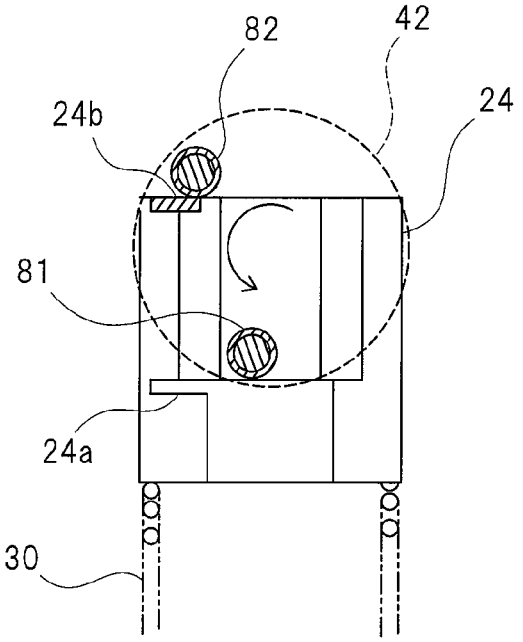
Figure 5D:
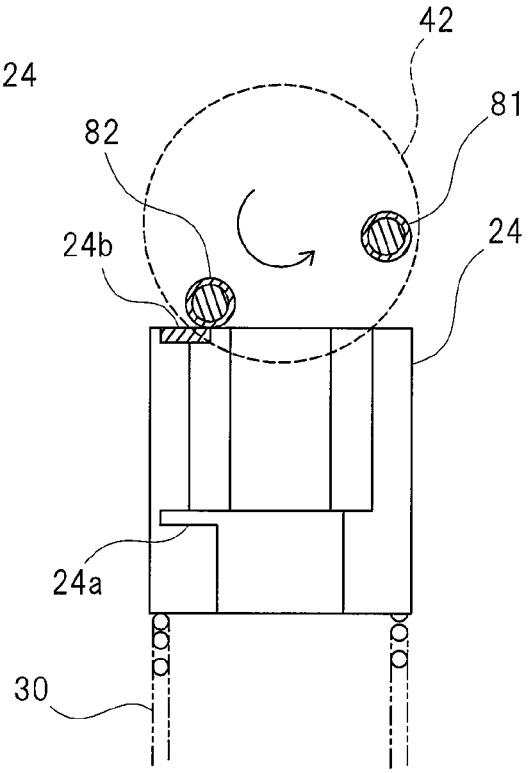

When the second pulley 42 is further rotated in the arrow direction, the second engagement pin 82 abuts on and is engaged with the second engagement protrusion 24*b* of the weight 24 from above as shown in FIG. 5C. When the second pulley 42 shown in FIG. 5C is rotated in the arrow direction, the weight 24 is further pushed down, and the coil spring 30 is further compressed. When the second pulley 42 is further rotated in the arrow direction, the first engagement pin 81 is moved away from the first engagement protrusion 24*a* as shown in FIG. 5D. That is, the engagement between the first engagement pin 81 and the first engagement protrusion 24*a* is released. As a matter of course, the engagement between the second engagement pin 82 and the second engagement protrusion 24*b* is maintained. When the second pulley 42 shown in FIG. 5D is rotated in the arrow direction, the weight 24 is further pushed down and is moved down to the position shown in FIG. 3. In this manner, the first engagement pin 81 and the second engagement pin 82 are sequentially engaged with the weight 24. Specifically, the first engagement pin 81 is engaged with the weight 24 earlier than the second engagement pin 82 so as to push the weight 24 down against the bias of the coil spring 30. The second engagement pin 82 is engaged with the weight 24 later than the first engagement pin 81 so as to further push the weight 24 down against the bias of the coil spring 30. In other words, the first engagement pin 81 and the second engagement pin 82 are coordinated with each other to push the weight 24 down from the position shown in FIG. 1 to the position shown in FIG. 3. That is, the position shown in FIG. 1 is a top dead point of the weight 24, and the position shown in FIG. 3 is a bottom dead point of the weight 24.

As described above, the second power transmission path is configured between the second pulley 42 and the weight 24 by the first engagement pin 81 and the second engagement pin 82 protruding from the second pulley 42, and the weight 24 is moved from the top dead point to the bottom dead point by the drive force transmitted via this path. At this time, the weight 24 is moved while compressing the coil spring 30. In other words, the weight 24 is moved downward against the bias of the coil spring 30. Note that it is obvious from the above-described explanations that the plunger 21 is moved from the bottom dead point to the top dead point while the weight 24 is moved from the top dead point to the bottom dead point along with the rotation of the second pulley 42. That is, the weight 24 is moved downward when the plunger 21 is moved upward.

When the weight 24 reaches the bottom dead point, the second engagement pin 82 shown in FIG. 5D is moved away from the second engagement protrusion 24*b* shown in this drawing, so that the engagement between the second engagement pin 82 and the second engagement protrusion 24*b* is released. That is, the engagements between the first engagement pin 81 and the second engagement pin 82 and the weight 24 are completely released.

When the engagements between the first engagement pin 81 and the second engagement pin 82 and the weight 24 are released, the weight 24 is pushed up by the elastic restoring force of the compressed coil spring 30. That is, the weight 24 is moved upward (in the second direction) by the bias of the coil spring 30. In other words, the weight 24 is moved upward from the bottom dead point shown in FIG. 3 to the top dead point shown in FIG. 1 at once.

Here, timing is set so that the engagements between the first engagement pin 81 and the second engagement pin 82 and the weight 24 shown in FIG. 5A to 5D are released at the same time as the switching of the clutch mechanism 60 shown in FIG. 3 from the fastened state to the released state. That is, the upward movement of the weight 24 starts at the same time as the start of the downward movement of the plunger 21.

In the nail driver 1A in the present embodiment, the reaction caused at the driving is absorbed by the reaction force caused by the upward movement of the weight 24 as described above. Hereinafter, the mechanism of the reaction absorption will be explained in detail.

As described above, the plunger 21 shown in FIG. 3 is at the top dead point, and the weight 24 is at the bottom dead point. In the state shown in FIG. 3, the plunger 21 is pulled in the direction away from the injection outlet 14*a* (upward) against the bias of the coil spring 25. On the other hand, the weight 24 is pushed in the direction close to the injection outlet 14*a* (downward) against the bias of the coil spring 30. At this time, the biasing forces of the coil spring 25 and the coil spring 30 are received by the housing 10 and are balanced. That is, the biasing force of the coil spring 25 and the biasing force of the coil spring 30 are balanced with each other.

Then, when the clutch mechanism 60 shown in FIG. 3 is switched from the fastened state to the released state, the movement of the plunger 21 in the direction close to the injection outlet 14*a* is started by the bias of the coil spring 25. That is, the downward movement of the plunger 21 is started. At the same time as this, the engagement between the second engagement pin 82 provided on the second pulley 42 and the second engagement protrusion 24*b* provided on the weight 24 is released, so that the weight 24 freely moves (see FIG. 5). The movement of the weight 24 which can freely move is started in the direction away from the injection outlet 14*a* by the bias of the coil spring 30. That is, the upward movement of the weight 24 is started.

When the downward movement of the plunger 21 is started, such force (f1) as separating the nail driver 1A from the material W to be driven is generated by the bias reaction force of the coil spring 25 and the drive reaction force of the nail 100. That is, the reaction is generated.

However, in the nail driver 1A according to the present embodiment, at the same time as the start of the downward movement of the plunger 21, the upward movement of the weight 24 is started by the bias of the coil spring 30. In other words, the coil spring 30 biases the weight 24 in the direction away from the injection outlet 14*a*. Therefore, bias reaction force is generated at the part that receives the coil spring 30 on the opposite side of the weight 24. That is, such force (f2) that the nail driver 1A gets close to the material W to be driven is generated, the force (f1) is cancelled out, so that the reaction is absorbed or reduced.

Then, along with the rotation of the second pulley 42 shown in FIG. 5D, the clutch mechanism 60 shown in FIG. 1 is switched from the released state to the fastened state. The first engagement pin 81 and the second engagement pin 82 return to the positions shown in FIG. 5B, are engaged with the weight 24 again, and push the weight 24 down. That is, at the timing when the clutch mechanism 60 is switched between the fastened state and the released state, the first engagement pin 81 and the second engagement pin 82 are switched to the engaged state in which they are engaged with the weight 24 and an unengaged state in which they are not engaged with the weight 24.

In the nail driver 1A according to the present embodiment, the plunger 21 is moved in the first direction (driving direction) by the bias of the first elastic body and is moved in the second direction (the direction opposite to the driving direction) by the drive force transmitted via the first power transmission path. On the other hand, the weight 24 is moved to the second direction (the direction opposite to the driving direction) by the bias of the second elastic body and is moved in the first direction (driving direction) by the drive force transmitted via the second power transmission path. The first power transmission path and the second power transmission path are independent from each other. That is, the plunger 21 and the weight 24 reciprocate in the first direction and the second direction so as to be independent from each other. Therefore, even if the movement of the plunger 21 in the first direction is suddenly stopped due to any reason, the movement of the weight 24 in the second direction is not affected.

In the nail driver 1A according to the present embodiment, the plunger 21, the weight 24, and the coil spring 25 serving as the first elastic body are coaxially disposed. Therefore, the axis on which the reaction caused when the coil spring 25 biases the plunger 21 at the driving operation and the repulsive force of the driver blade 22 received from the nail 100 or the material W to be driven act and the axis on which the force caused by movement of the weight 24 act are close to each other, so that generation of a moment is suppressed.

Second Embodiment

Hereinafter, another example of the embodiments of the driver of the present invention will be explained in detail with reference to FIG. 6 to FIG. 10. The driver according to the present embodiment is a nail driver which drives a nail serving as a fastener into a material to be driven such as a wood material or a gypsum board by a reciprocating driver blade, and is provided with a basic structure which is common with that of the nail driver 1A according to the first embodiment. Accordingly, different points from those of the nail driver 1A according to the first embodiment will be explained below, and explanations about common points will be omitted. In the configurations shown in the drawings referenced in the following explanations, the same reference symbols are used for the configurations which are the same or substantially the same as the configurations shown in FIG. 1 to FIG. 5.

Figure 6:
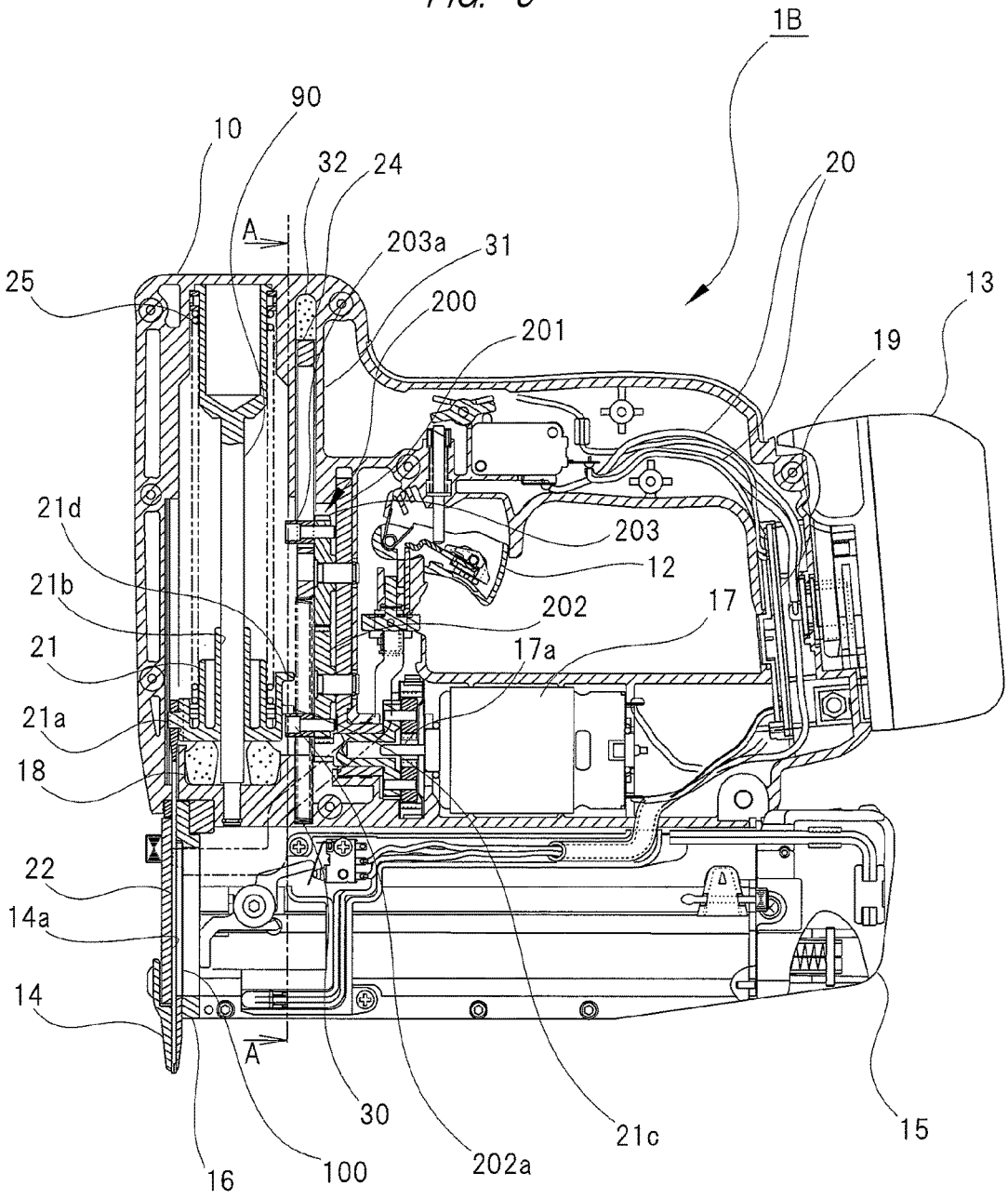
FIG. 6 is a cross-sectional view of a nail driver according to a second embodiment and is a cross-sectional view obtained when the plunger is positioned at a bottom dead point and the weight is positioned at a top dead point.
Figure 7:
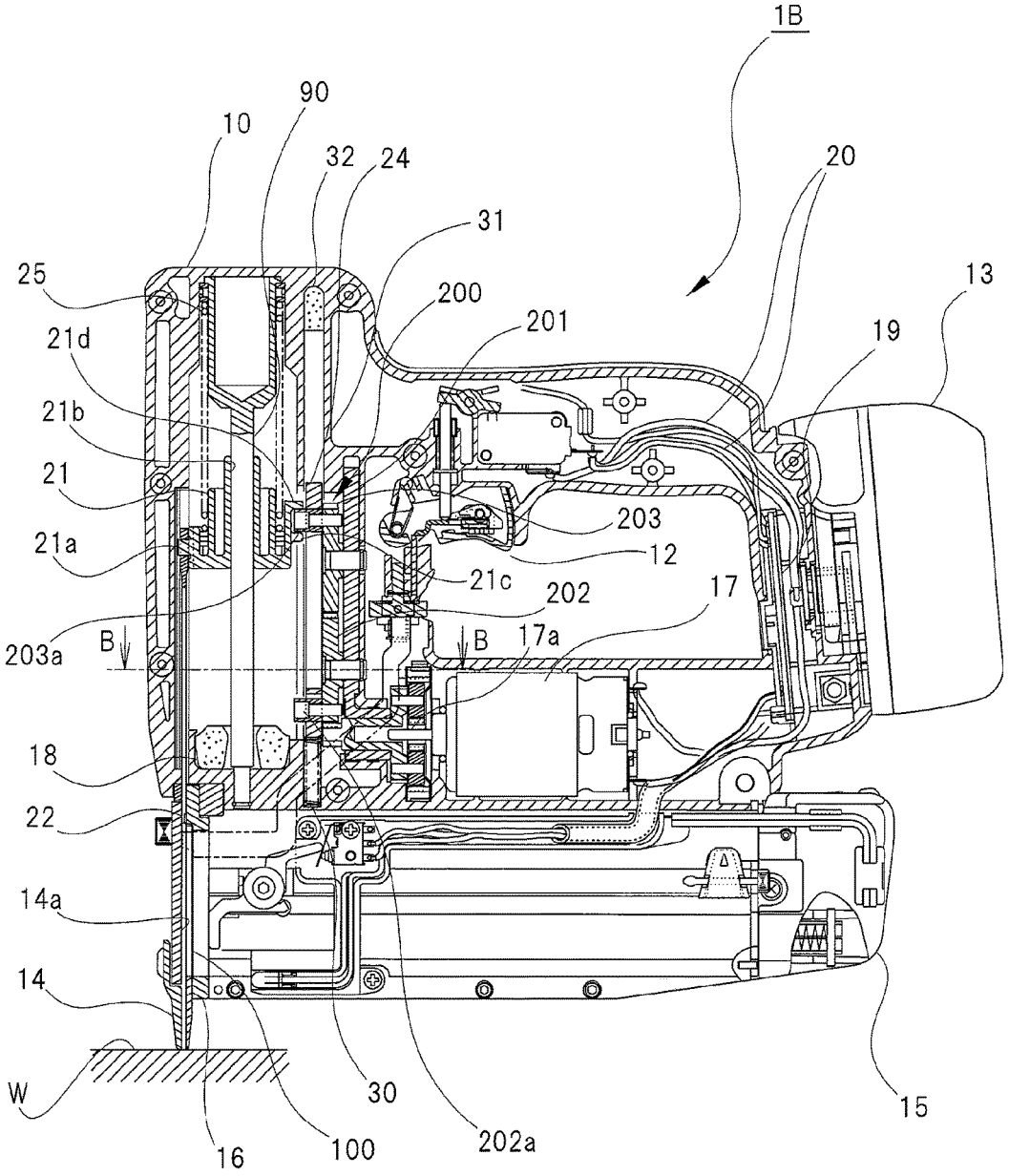
FIG. 7 is a partial cross-sectional view of the nail driver according to the second embodiment and is a partial enlarged cross-sectional view obtained when the plunger is positioned at a top dead point and the weight is positioned at a bottom dead point.

FIG. 6 is a cross-sectional view of a nail driver 1B according to the present embodiment, the plunger 21 shown in the drawing is at the bottom dead point, and the weight 24 is at the top dead point. FIG. 7 is another cross-sectional view of the nail driver 1B according to the present embodiment, the plunger 21 shown in the drawing is at the top dead point, and the weight 24 is at the bottom dead point. As shown in FIG. 6 and FIG. 7, a coupling part 21*a* engaged with the driver blade 22 is provided to protrude from a side part of the plunger 21, and the plunger 21 and the driver blade 22 are coupled to each other via the coupling part 21*a*. Therefore, along with (upward/downward) movement of the plunger 21, the driver blade 22 is also moved (upward/downward). A guide hole 21*b* penetrating through a guide shaft 90 provided in the housing 10 is provided at the center of the plunger 21, and the plunger 21 reciprocates in the first direction and the second direction in the housing 10 in accordance with guidance of the guide shaft 90. That is, the plunger 21 and the driver blade 22 are moved upward/downward in the housing 10.

Figure 8:
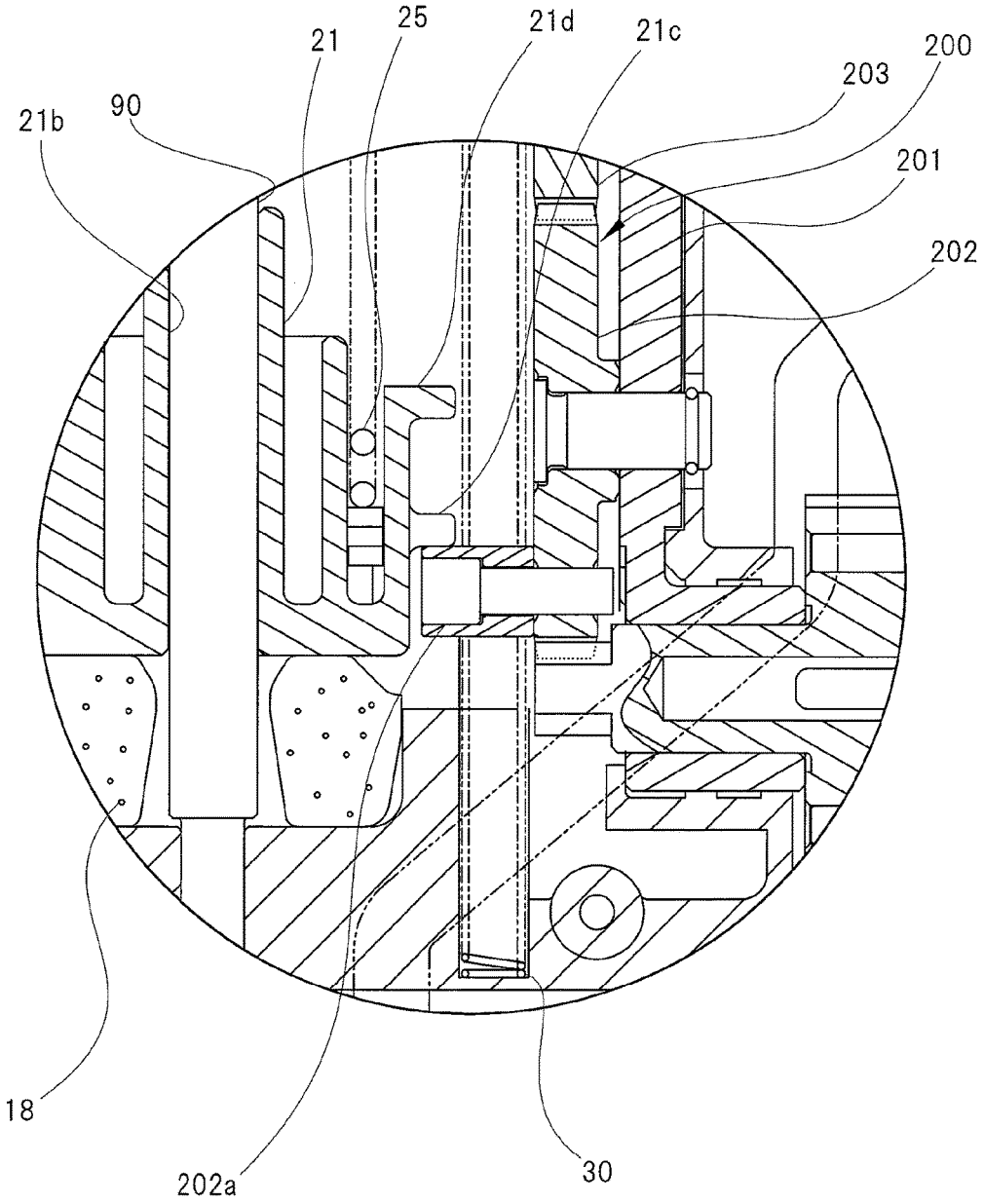
FIG. 8 is a partial enlarged cross-sectional view of the nail driver according to the second embodiment and is an enlarged cross-sectional view in vicinity of a drive cam.
Figure 9A:
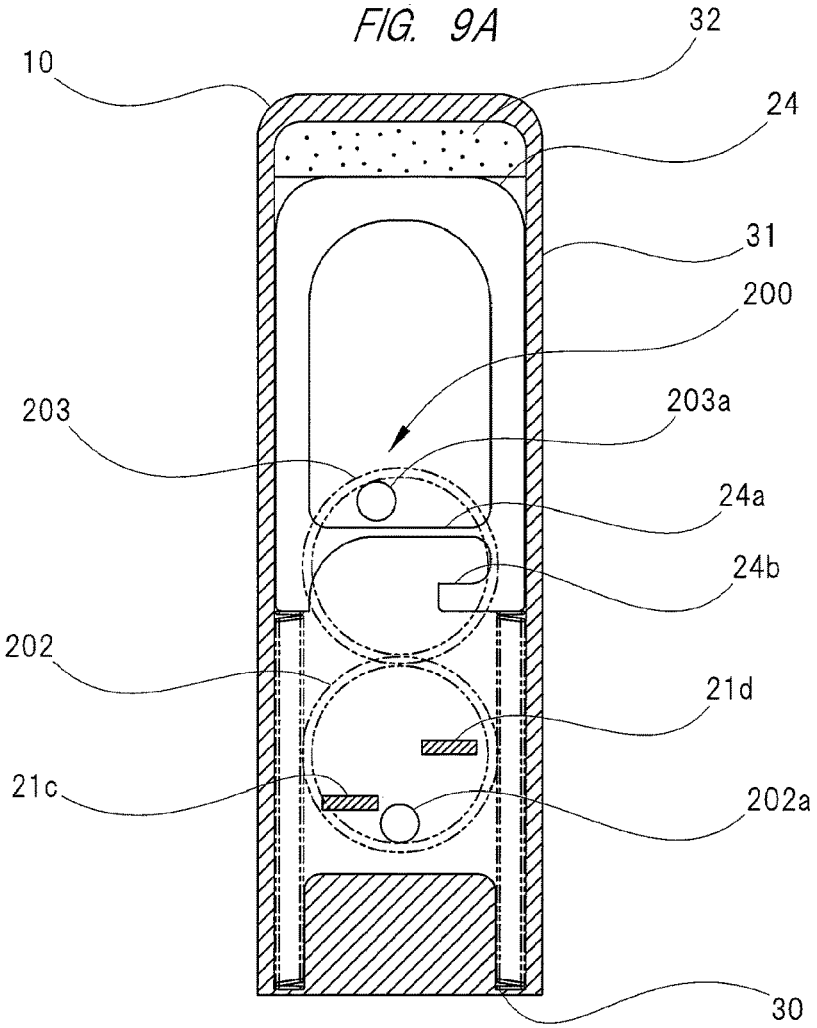
FIG. 9A is a partial cross-sectional view taken along a line A-A shown in FIG. 6.
Figure 9B:
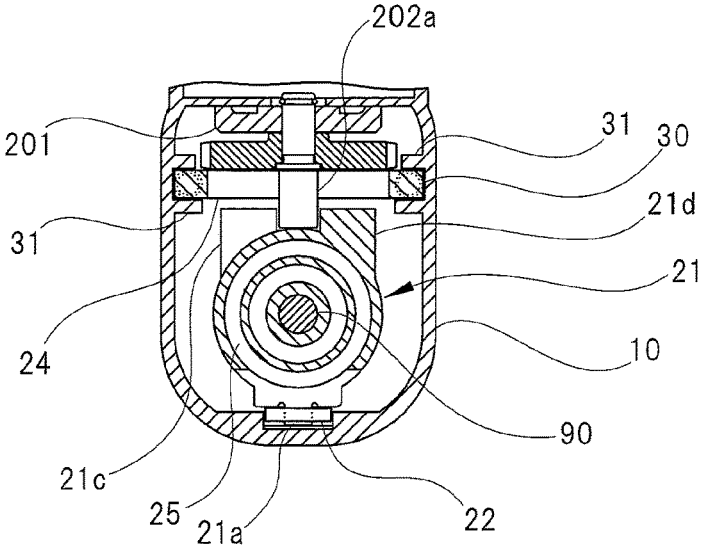
FIG. 9B is a partial cross-sectional view taken along a line B-B shown in FIG. 7.

FIG. 8 is an enlarged cross-sectional view of the vicinity of a drive cam 200 shown in FIG. 6 and FIG. 7. FIG. 9A is a partial cross-sectional view taken along a line A-A shown in FIG. 6, and FIG. 9B is a partial cross-sectional view taken along a line B-B shown in FIG. 7. As shown in FIG. 6 to FIG. 9, a first latch part 21*c* and a second latch part 21*d* engaged with the drive cam 200 are provided to protrude from side parts of the plunger 21. As shown in FIG. 6 and FIG. 7, the first latch part 21*c* and the second latch part 21*d* protrude in the direction opposite to the protruding direction of the coupling part 21*a*. The first latch part 21*c* and the second latch part 21*d* are provided at different heights from each other (relative positions with respect to the injection outlet 14*a*). Specifically, the first latch part 21*c* is provided at a position closer to the injection outlet 14*a* than the second latch part 21*d*. In other words, the first latch part 21*c* is provided at a position lower than the second latch part 21*d*.

The plunger 21 shown in FIG. 6 is pushed up to the position shown in FIG. 7 against the bias of the coil spring 25 by the drive cam 200 rotated by the electric motor 17. The electric motor 17 is driven by the trigger which is the operation of the trigger switch 12, and the drive is stopped when the movement of the plunger 21 up to a predetermined position is detected by a not-shown microswitch. In other words, when the trigger switch 12 is operated, the electric motor 17 continues operating until the plunger 21 is moved up to the predetermined position. Note that the electric-power control part 19 is provided with a CPU, a RAM, etc., and controls the electric motor 17 based on signals output from the trigger switch 12 and the microswitch.

The drive cam 200 pushes the plunger 21 up by rotating in a state in which it is engaged with the plunger 21. Then, when the engagement between the drive cam 200 and the plunger 21 is released, the plunger 21 is moved by the bias of the coil spring 25, and the driver blade 22 coupled to the plunger 21 is also moved. That is, the driver blade 22 is rapidly moved down toward the injection outlet 14*a*, and the nail 100 supplied from the magazine 15 shown in FIG. 7 is ejected. Details will be described below.

As shown in FIG. 6, FIG. 7, and FIG. 9, a first gear 202 and a second gear 203 which are rotating bodies configuring the drive cam 200 are attached to a gear holder 201 fixed to the housing 10 so as to freely rotate. A planetary gear mechanism is provided between the first gear 202 and the output shaft 17*a* of the electric motor 17, and the first gear 202 and the second gear 203 are always meshed with each other. When the output shaft 17*a* of the electric motor 17 is rotated, the rotation is transmitted to the first gear 202 via the planetary gear mechanism to rotate the first gear 202, and the second gear 203 is rotated by the rotation of the first gear 202.

The first gear 202 is provided with a cam roller 202*a*, and the second gear 203 is provided with a cam roller 203*a*. The first gear 202 and the second gear 203 are disposed in up and down directions, and the first gear 202 is disposed at a position closer to the injection outlet 14*a* than that of the second gear 203. That is, the first gear 202 is disposed at a position lower than that of the second gear 203. The plunger 21 shown in FIG. 6 is engaged with the cam rollers 202*a* and 203*a* in the order of the cam roller 202*a* of the first gear 202 and the cam roller 203*a* of the second gear 203 and is gradually pushed up. Note that the cam rollers 202*a* and 203*a* are configured of pins which protrude from side surfaces of the first gear 202 and the second gear 203, and rollers which are attached to distal ends of the pins so as to freely rotate.

On the other hand, as shown in FIG. 6, FIG. 7, and FIG. 9, the weight 24 is disposed between the plunger 21 and the drive cam 200 and can be guided by a guide wall 31 which extends along the moving direction of the plunger 21, and can be moved in parallel to the plunger 21. The drive cam 200 pushes the weight 24 down by rotating in a state in which it is engaged with the weight 24. Then, when the engagement between the drive cam 200 and the weight 24 is released, the weight 24 is moved in the direction opposite to the moving direction of the plunger 21 by the bias of the coil spring 30. That is, the weight 24 is moved up in the direction away from the injection outlet 14*a*. Details will be described below.

As shown in FIG. 9A, a first engagement protrusion 24*a* which is engaged with the cam roller 203*a* protruding from the second gear 203 and a second engagement protrusion 24*b* which is engaged with the cam roller 202*a* protruding from the first gear 202 are formed on the weight 24. The weight 24 is engaged with the cam rollers 202*a* and 203*a* in the order of the cam roller 203*a* of the second gear 203 and the cam roller 202*a* of the first gear 202 and is gradually pushed down. As described above, the plunger 21 (FIG. 6) is engaged with the cam rollers 202*a* and 203*a* in the order of the cam roller 202*a* of the first gear 202 and the cam roller

203*a* of the second gear 203 and is gradually pushed up. That is, the drive cam 200 gradually pushes down the weight 24 while gradually pushing up the plunger 21. Hereinafter, the movement of the plunger 21 and the weight 24 will be explained in detail with reference to FIGS. 10A to 10F.

Figures 10A, 10B, 10C, 10D, 10E, 10F:
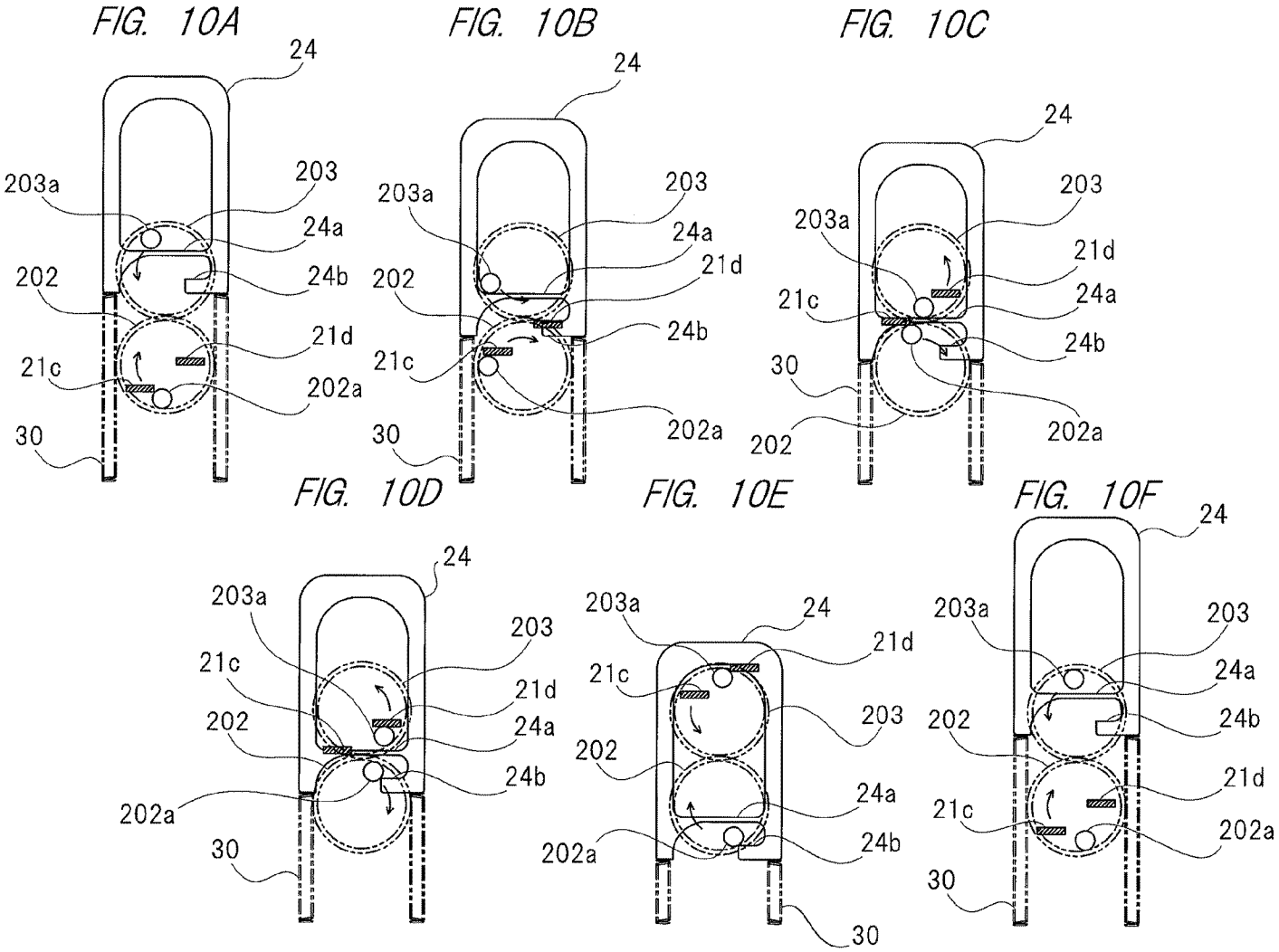
FIGS. 10A to 10F are schematic views showing changes in the engagement state of the plunger and the weight and cam rollers.

The weight 24 shown in FIG. 10F is at the top dead point. That is, the position of the weight 24 shown in FIG. 10F is the same as the position shown in FIG. 6. When the weight 24 is at the position (top dead point) shown in FIG. 6, the plunger 21 shown in the same drawing is at the bottom dead point. That is, ejection of the nail 100 by the driver blade 22 is completed.

When the first gear 202 and the second gear 203 shown in FIG. 10F are rotated in the arrow directions in the drawing, the cam roller 202*a* of the first gear 202 is engaged with the first latch part 21*c* of the plunger 21 (FIG. 6) from below as shown in FIG. 10A, and then, the cam roller 203*a* of the second gear 203 is engaged with the first engagement protrusion 24*a* of the weight 24 from above. Then, as shown in FIG. 10B, the plunger 21 is pushed up against the bias of the coil spring 25 (FIG. 6) along with the rotation of the first gear 202, and the weight 24 is pushed down against the bias of the coil spring 30 along with the rotation of the second gear 203. As shown in FIGS. 10C and 10D, when the cam roller 202*a* is moved to the highest position, the engagement between the cam roller 202*a* and the first latch part 21*c* of the plunger 21 is released. As a matter of course, before the engagement between the cam roller 202*a* and the first latch part 21*c* is released, the cam roller 203*a* of the second gear 203 is separated away from the first engagement protrusion 24*a* of the weight 24 and is engaged with the second latch part 21*d* of the plunger 21 from below. Furthermore, the cam roller 202*a* separated away from the first latch part 21*c* of the plunger 21 is subsequently engaged with the second engagement protrusion 24*b* of the weight 24 from above.

Then, as shown in FIGS. 10D and 10E, the plunger 21 is further pushed up along with the rotation of the first gear 202, and the weight 24 is further pushed down along with the rotation of the second gear 203. That is, each of the plunger 21, the driver blade 22, and the weight 24 at the positions shown in FIG. 6 is moved to the position shown in FIG. 7. Then, when the cam roller 203*a* is moved to the highest position, the engagement between the cam roller 203*a* and the second latch part 21*d* of the plunger 21 is released. Immediately after that, the cam roller 202*a* reaches the lowest position, and the engagement between the cam roller 202*a* and the second engagement protrusion 24*b* of the weight 24 is also released. That is, the engagements between the plunger 21 and the weight 24 and the drive cam 200 are sequentially released in an extremely short interval. Therefore, the downward movement of the plunger 21 is started by the bias of the coil spring 25 shown in FIG. 7, and, immediately after that, the upward movement of the weight 24 is started by the bias of the coil spring 30. In this manner, the driver blade 22 coupled to the plunger 21 is moved toward the injection outlet 14*a* and ejects the nail 100, and the weight 24 is moved in the direction away from the injection outlet 14*a* and absorbs the reaction caused along with the nail ejection. As described above, when the upward movement of the weight 24 is started, the engagements between the plunger 21 and the weight 24 and the drive cam 200 are released. Therefore, even when the downward movement (movement in the first direction) of the plunger 21 is rapidly stopped due to any reason, the upward movement (movement in the second direction) of the weight 24 is not affected at all. That is, the plunger 21 and the weight 24 reciprocate in the first direction and the second direction so as to be independent from each other.

Note that the electric-power control part 19 shown in FIG. 6 and FIG. 7 continues operating the electric motor 17 until the cam roller 202*a* and the cam roller 203*a* are moved to the positions shown in FIG. 10E even after the driving operation of the nail 100 is finished as described above. When the cam roller 202*a* and the cam roller 203*a* are moved to the positions shown in FIG. 10E, the above-described microswitch is pushed down by the plunger 21 which has been pushed up, and a predetermined signal is outputted from the microswitch. When the electric-power control part 19 receives the signal outputted from the microswitch, the electric-power control part 19 stops the electric motor 17. As shown in FIG. 6, the plunger 21 moved down to the bottom dead point abuts on the piston bumper 18, and the weight 24 moved up to the top dead point abuts on a weight bumper 32.

Modification Example

Next, one of modification examples of the nail driver 1B according to the second embodiment will be explained. In the nail driver 1B according to the second embodiment, one cam roller is provided each of the first gear 202 and the second gear 203. However, as shown in FIG. 11 and FIG. 12, there is also an embodiment in which the first gear 202 is provided with a cam roller 202*a* and a cam roller 202*b*, and the second gear 203 is provided with a cam roller 203*a*.

Figure 11:
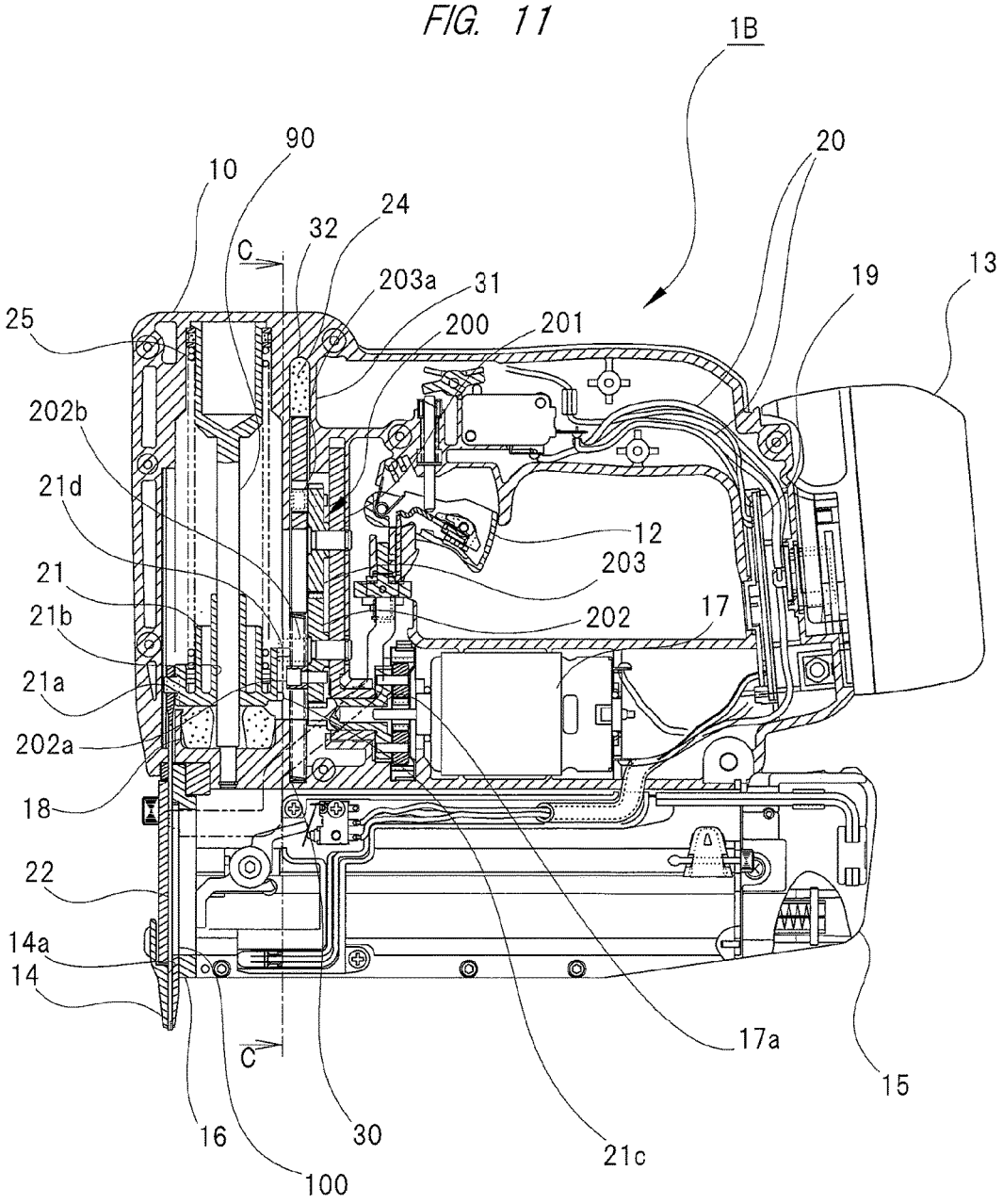
FIG. 11 is a cross-sectional view showing a modification example of a nail driver according to the second embodiment.
Figure 12:
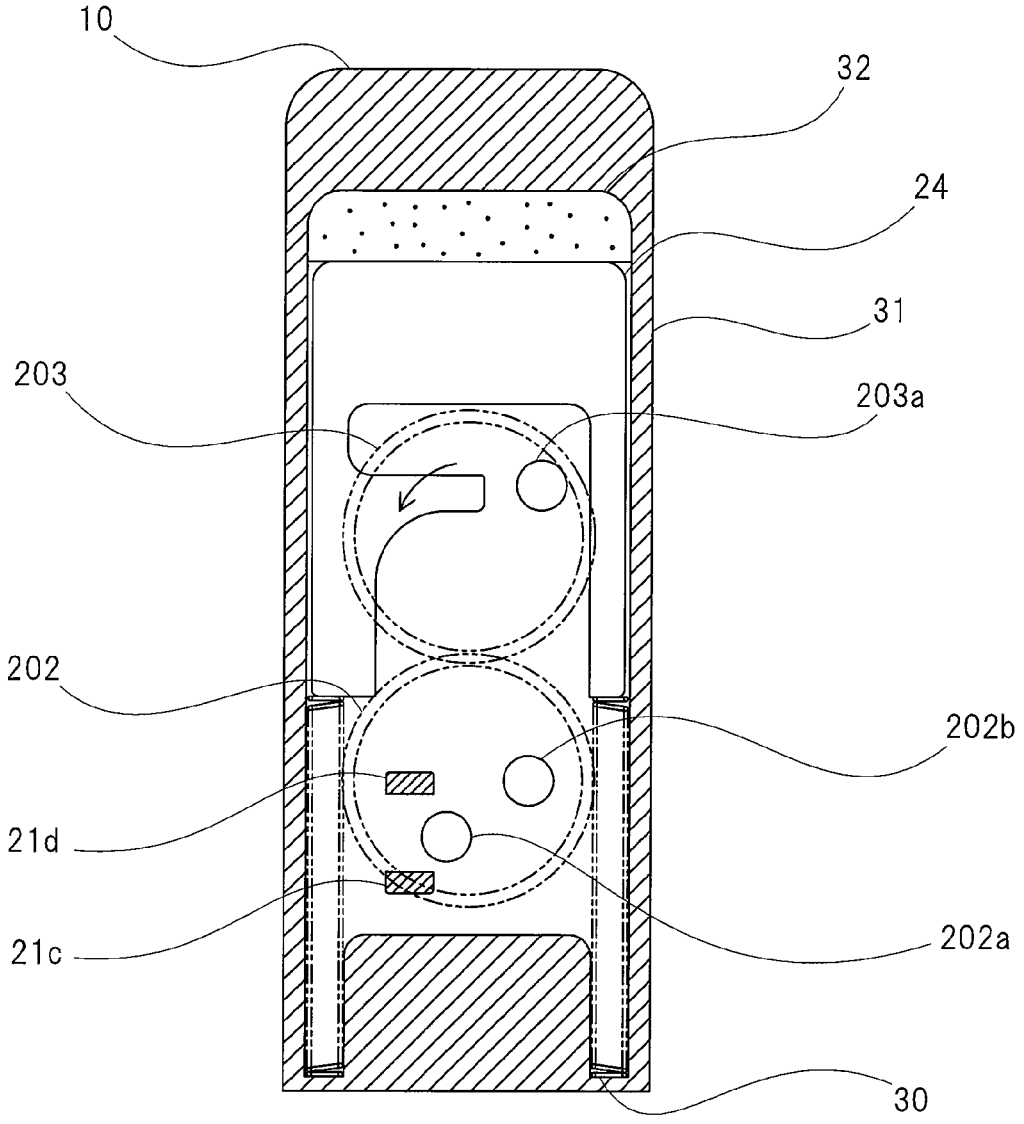
FIG. 12 is a partial cross-sectional view taken along a line C-C shown in FIG. 11.

As shown in FIG. 11, the cam roller 202*b* is longer than the cam roller 202*a*. That is, the protruding length of the cam roller 202*b* with respect to the side surface of the first gear 202 is longer than the protruding length of the cam roller 202*a*. In accordance with the difference in the length between the cam roller 202*a* and the cam roller 202*b*, the lengths of the first latch part 21*c* and the second latch part 21*d* of the plunger 21 are also different from each other. Specifically, the second latch part 21*d* is longer than the first latch part 21*c*. That is, the protruding length of the second latch part 21*d* with respect to the side surface of the plunger 21 is longer than the protruding length of the first latch part 21*c*. As shown in FIG. 12, the first latch part 21*c* and the second latch part 21*d* are disposed to be arranged in one row along the up and down direction.

Next, movements of the plunger 21 and the weight 24 will be explained in detail with reference to FIGS. 13A to 13F. The weight 24 shown in FIG. 13F is at the top dead point. That is, the position of the weight 24 shown in FIG. 13F is the same as the position shown in FIG. 6. When the weight 24 is at the position (top dead point) shown in FIG. 6, the plunger 21 shown in this drawing is at the bottom dead point. That is, ejection of the nail 100 by the driver blade 22 is completed.

Figure 13A:
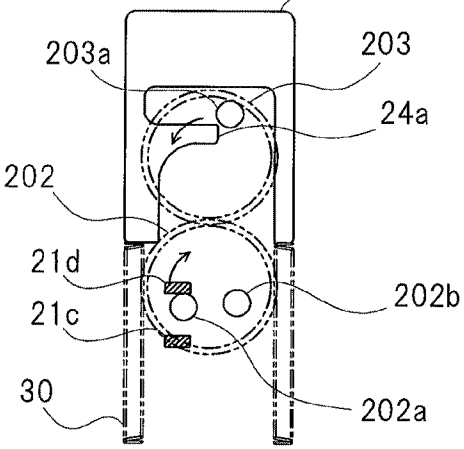
FIGS. 13A to 13F are schematic views showing changes in the engagement state of the plunger and the weight and the cam rollers.
Figure 13B:
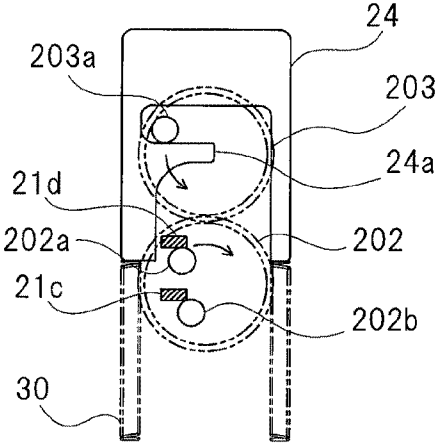
Figure 13C:
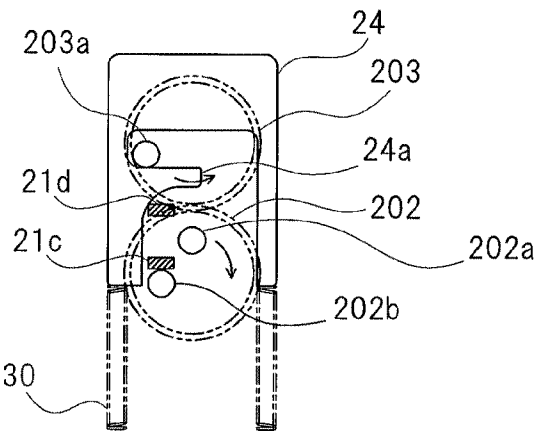
Figure 13D:
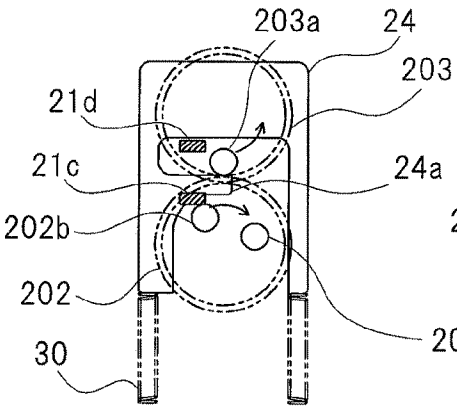
Figure 13E:
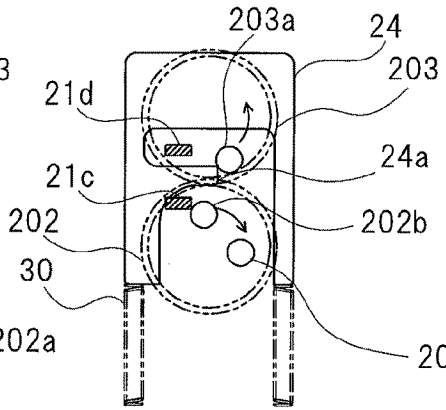
Figure 13F:
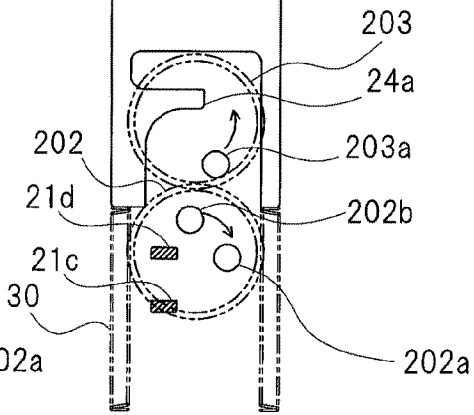

When the first gear 202 and the second gear 203 shown in FIG. 13F are rotated in the arrow direction the in the drawing, the cam roller 202*a* of the first gear 202 is engaged with the second latch part 21*d* of the plunger 21 (FIG. 11) from below as shown in FIG. 13A, and then, the cam roller 203*a* of the second gear 203 is engaged with the first engagement protrusion 24*a* of the weight 24 from above. Then, as shown in FIG. 13B, the plunger 21 is pushed upward against the bias of the coil spring 25 (FIG. 11) along with the rotation of the first gear 202, and the weight 24 is pushed downward against the bias of the coil spring 30 along with the rotation of the second gear 203. As shown in FIG. 13C, when the first gear 202 and the second gear 203 are further rotated, the engagement between the cam roller 202*a* and the second latch part 21*d* of the plunger 21 is released.

As a matter of course, as shown in FIG. 13B, before the engagement between the cam roller 202*a* and the second latch part 21*d* is released, the cam roller 202*b* is engaged with the first latch part 21*c* of the plunger 21.

Then, as shown in FIGS. 13C and 13D, the plunger 21 is further pushed up along with the rotation of the first gear 202, and the weight 24 is further pushed down along with the rotation of the second gear 203. That is, each of the plunger 21, the driver blade 22, and the weight 24 at the positions shown in FIG. 6 is moved to the position shown in FIG. 7. Then, as shown in FIG. 13E, when the cam roller 202*b* is moved to the highest position, the engagement between the cam roller 202*b* and the first latch part 21*c* of the plunger 21 is released, and, at the same time, the engagement between the cam roller 203*a* and the first engagement protrusion 24*a* of the weight 24 is also released. That is, the engagements between the plunger 21 and the weight 24 and the drive cam 200 are released. Therefore, at the same time as the start of the downward movement of the plunger 21 by the bias of the coil spring 25 shown in FIG. 7, the upward movement of the weight 24 is started by the bias of the coil spring 30. In this manner, as shown in FIG. 11, the driver blade 22 coupled to the plunger 21 is moved toward the injection outlet 14*a* and ejects the nail 100, the weight 24 is moved in the direction away from the injection outlet 14*a* and absorbs the reaction caused along with the nail driving. As described above, when the upward movement of the weight 24 is started, the engagements between the plunger 21 and the weight 24 and the drive cam 200 are released. Therefore, even when the downward movement (movement in the first direction) of the plunger 21 is suddenly stopped due to any reason, the upward movement (movement in the second direction) of the weight 24 is not affected at all. That is, the plunger 21 and the weight 24 reciprocate in the first direction and the second direction so as to be independent from each other.

The present invention is not limited to the above-described embodiments, and various modifications can be made within the scope of the present invention. For example, in the above-described embodiments, the upward movement of the weight 24 is started at the same time as or immediately after the downward movement of the plunger 21 is started. However, there is also an embodiment in which the upward movement of the weight 24 is started immediately before the downward movement of the plunger 21 is started. Moreover, the moving strokes of the plunger 21 and the weight 24 are not particularly limited. As a matter of course, the reaction at the driving is effectively absorbed when the value obtained by multiplying the mass of the plunger 21 by the moving stroke of the plunger 21 and the value obtained by multiplying the mass of the weight 24 by the moving stroke of the weight 24 are the same or substantially the same as each other. Therefore, if the moving stroke of the weight 24 is short, it is required to increase the mass of the weight 24 by the short degree of the moving stroke. Therefore, from the viewpoint of sufficiently absorbing the reaction at the driving while avoiding the increase in the weight of the nail driver as much as possible, the moving stroke of the weight 24 is preferred to be ½ or more of the moving stroke of the plunger 21.

DESCRIPTION OF REFERENCE NUMERALS

066
1A, 1B NAIL DRIVER
10 HOUSING
11 HANDLE
12 TRIGGER SWITCH
13 BATTERY
14 NOSE PART
15 MAGAZINE
16 BLADE GUIDE
17 ELECTRIC MOTOR
18 PISTON BUMPER
20 CABLE
21 PLUNGER
21*a* COUPLING PART
21*b* GUIDE HOLE
21*c* FIRST LATCH PART
21*d* SECOND LATCH PART
22 DRIVER BLADE
23 CYLINDER
24 WEIGHT
24*a* FIRST ENGAGEMENT PROTRUSION
24*b* SECOND ENGAGEMENT PROTRUSION
25 COIL SPRING
30 COIL SPRING
31 GUIDE WALL
32 WEIGHT BUMPER
41 FIRST PULLEY
42 SECOND PULLEY
43 ROTARY SHAFT
44 BEARING
45 POWER TRANSMISSION BELT
50 SPEED REDUCTION MECHANISM
50*a* GEAR
50*b* GEAR
60 CLUTCH MECHANISM
70 DRUM
71 DRIVE SHAFT
72 WIRE
81 FIRST ENGAGEMENT PIN
82 SECOND ENGAGEMENT PIN
90 GUIDE SHAFT
100 NAIL
200 DRIVE CAM
201 GEAR HOLDER
202 FIRST GEAR
202*a*, 202*b*, 203*a* CAM ROLLER
203 SECOND GEAR

The invention claimed is:

1. A driver for driving a fastener into a material comprising:

a plunger configured to be moved in a first direction which is a driving direction of the fastener and to be moved in a second direction opposite to the first direction against bias of an elastic body;

a weight configured to be moved in the second direction when the plunger is moved in the first direction and to be moved in the first direction when the plunger is moved in the second direction;

a first gear and a second gear configured to be driven by a motor;

a first engagement part which is provided to the first gear and which is configured to be engaged with a plunger engagement part of the plunger; and a second engagement part which is provided to the second gear and which is configured to be engaged with a weight engagement part of the weight, wherein the weight is configured to be moved in the first direction by the second engagement part, and the plunger is configured to be moved in the second direction by the first engagement part.

2. The driver according to claim 1, wherein the driver further includes a guide part, and the plunger is configured for reciprocating motion in the guide part.

3. The driver according to claim 2, wherein the plunger, the weight, and the elastic body are coaxially disposed.

4. The driver according to claim 1, wherein the elastic body is a coil spring, the weight has a cylindrical shape, and the elastic body and the weight are coaxially disposed.

5. The driver according to claim 1, wherein the plunger, the weight, and the elastic body are coaxially disposed.

6. The driver according to claim 1, wherein the plunger is configured to be moved in the second direction by the first gear, the weight is configured to be moved in the first direction by the second gear, and the first gear has a first cam roller and a second cam roller as the first engagement part, and the second gear has a single cam roller as the second engagement part.

7. The driver according to claim 1, wherein the first gear has two cam rollers and the second gear has one cam roller, the plunger has first and second latch parts configured to be engaged with any of the cam rollers, and the cam rollers and the first and second latch parts respectively function as the first and second engagement parts, the first and second latch parts function as the plunger engagement part.

8. The driver according to claim 7, wherein a number of cam rollers of the first gear is more than a number of cam rollers of the second gear.

9. The driver according to claim 7, wherein the first and second latch parts are disposed to be arranged in one row in the first or second direction.

10. The driver according to claim 1, wherein the first gear has two cam rollers, and the second gear has one cam roller, the plunger has first and second latch parts configured to be engaged with any of the two cam rollers of the first gear, and the weight has an engagement protrusion configured to be engaged with the one cam roller of the second gear.

11. The driver according to claim 10, wherein the one cam roller of the second gear is configured not to be engaged with the first and second latch parts of the plunger.

12. A driver for driving a fastener into a material comprising:

a plunger configured to be moved in a first direction which is a driving direction of the fastener and to be moved in a second direction opposite to the first direction against bias of an elastic body;

a weight configured to be moved in the second direction when the plunger is moved in the first direction and to be moved in the first direction when the plunger is moved in the second direction;

a plunger moving mechanism including a first gear, the first gear configured to be engaged with the plunger to move the plunger in the second direction; and a weight moving mechanism including a second gear different from the first gear, the second gear configured to be engaged with the weight to move the weight in the first direction, wherein the plunger moving mechanism and the weight moving mechanism are configured to respectively move the plunger and the weight in the first direction and the second direction such that the movement of the plunger and the weight are independent from each other.

13. The driver according to claim 12, wherein the plunger moving mechanism includes first and second cam rollers, the weight moving mechanism includes a third cam roller, the first gear and the second gear are driven by a motor, the first and second cam rollers function as a first engagement part provided to the first gear to be engaged with the plunger, and the third cam roller functions as a second engagement part provided to the second gear to be engaged with the weight.

14. The driver according to claim 12, wherein the plunger moving mechanism includes first and second cam rollers, and first and second latch parts configured to be engaged with one of the first and second cam rollers, the weight moving mechanism includes a third cam roller, and the weight has an engagement protrusion configured to be engaged with the third cam roller.

15. The driver according to claim 14, wherein the third cam roller is configured not to be engaged with the first and second latch parts of the plunger.

16. A driver for driving a fastener into a material comprising:

a plunger configured to be moved in a first direction which is a driving direction of the fastener and to be moved in a second direction opposite to the first direction against bias of an elastic body;

a weight configured to be moved in the second direction when the plunger is moved in the first direction and to be moved in the first direction when the plunger is moved in the second direction;

a plunger moving mechanism configured to move the plunger in the second direction;

a weight moving mechanism configured to move the weight in the first direction, and including a gear and a cam roller; and an engagement protrusion protruding from the weight and configured to be engaged with the cam roller of the weight moving mechanism.

* * * * *